US006106182A

United States Patent [19]

Hamm et al.

[11] Patent Number: 6,106,182

[45] Date of Patent: Aug. 22, 2000

[54] VACUUM CLEANER HOOK ASSEMBLY

[75] Inventors: David T. Hamm, St. Louis; John F. Kaido, Arnold, both of Mo.

[73] Assignee: Tacony Corporation, Fenton, Mo.

[21] Appl. No.: 09/321,393

[22] Filed: May 27, 1999

[51] Int. Cl.[7] ..... A47L 9/26

[52] U.S. Cl. ..... 403/96; 403/91; 403/103; 403/165; 15/410; 15/423

[58] Field of Search ..... 15/410, 323; 403/96, 403/91, 103, 99, 164, 165, 97

[56] References Cited

U.S. PATENT DOCUMENTS

| | | | |
|---|---|---|---|
| 1,894,343 | 1/1933 | Butzer . | |
| 2,747,683 | 5/1956 | Ziegler, Jr. | 183/36 |
| 2,946,071 | 7/1960 | Nilsson . | |
| 3,251,107 | 5/1966 | Scott . | |
| 3,350,858 | 11/1967 | Verhagen | 55/376 |
| 4,062,430 | 12/1977 | Momberg | 191/12 R |
| 4,707,169 | 11/1987 | Wareham et al. | 55/357 X |
| 4,809,393 | 3/1989 | Goodrich et al. | 15/323 |
| 5,168,598 | 12/1992 | Hashizume et al. | 15/323 |
| 5,303,447 | 4/1994 | McKnight | 15/323 |
| 5,713,103 | 2/1998 | Keebler et al. | 15/323 |

FOREIGN PATENT DOCUMENTS

| | | | |
|---|---|---|---|
| 1165072 | 5/1958 | France . | |
| 3207099 | 9/1983 | Germany . | |
| 3935213 | 4/1991 | Germany | 15/410 |
| 4032899 | 4/1992 | Germany . | |
| 4008330 | 1/1992 | Japan | 15/323 |
| 4152927 | 5/1992 | Japan | 15/323 |
| 4189330 | 7/1992 | Japan | 15/323 |
| 66348 | 4/1950 | Netherlands . | |
| 127842 | 2/1950 | Sweden . | |
| 8601089 | 2/1986 | WIPO | 15/323 |

*Primary Examiner*—Terry Lee Melius
*Assistant Examiner*—John R. Cottingham
*Attorney, Agent, or Firm*—Senniger, Powers, Leavitt & Roedel

[57] ABSTRACT

A hook assembly for a vacuum cleaner handle which has a base member formed in the handle with a continuously internally walled extension defining an opening into which a continuously externally walled extension of a hook member can be inserted so that portions of the externally walled extension engage portions of the internally walled extension so that loads applied to the hook are transmitted to the handle through those surfaces. A spring normally biases the surfaces together, but can be manually overcome to rotate the hook for easy removal of the cord. A double hook arrangement is also provided to support a vacuum hose and an electrical cord with similar interengaging surfaces to transmit the load.

2 Claims, 4 Drawing Sheets

VACUUM CLEANER HOOK ASSEMBLY

BACKGROUND OF THE INVENTION

1. Field of the Invention

The present invention relates to vacuum cleaners and more particularly to the cord support which holds the electrical cord when it is wound up for storage.

2. Prior Art

Older vacuum cleaners, particularly those whose handles were made of metal, were provided with hooks near the top and bottom of the handle to allow the electrical cord of the vacuum cleaner to be sound about the two hooks for easy storage. The hooks were also of metal and were generally merely screwed to the handle in a fixed position. This required that the cord be wound and unwound one wrap at a time. Later, particularly with the advent of vacuum cleaners made of plastic parts including the handle, provision was made for the ability to rotate at least one of the hooks, usually the top hook, on the handle to allow the hook portion to be moved to a position where the cord could simply be slid off of the hook with out unwinding the cord. Thus, the cord could be removed more quickly. The hook could then be returned to its normal position for again winding the cord back on to the pair of hooks for storage.

These hooks, whether made of plastic or metal, were fixed to the plastic handle by means of a single screw about which the hook could be rotated. Some were spring loaded and provided with a positioning detent or the like to fix the hook in the cord winding position, but allow it to be rotated to more easily remove the cord. Unfortunately, it is a common problem in such constructions that the hook connection to the handle is easily broken since all forces are applied through the screw and there is no additional contact surfaces to spread out the loads that are applied when the hook is being rotated or when the cord is being wrapped onto the hooks. Thus, it is a common problem in such constructions to break parts or permanently destroy the connection between the hook and handle by distortion of the plastic around the threaded hole in the handle receiving the screw.

SUMMARY OF THE INVENTION

The present invention overcomes the difficulties and disadvantages of the prior art by providing a hook assembly for a vacuum cleaner which is so constructed and arranged as to spread out the loads on the hook, handle and attachment parts, which are manually applied to the hook when the hook is being rotated or when the cord is being wound on the hooks, and thus, substantially reduce the incidence of breakage.

These advantages are achieved by providing a hook assembly for a vacuum cleaner handle which includes a base member integrally formed with the handle that provides a continuous internal surface, a hook member with a mating continuous surface, a threaded connector extending through the hook member and engaging the base member and a spring concentrically mounted with the threaded connector so as to engage the hook member and bias the mating planar surfaces of the hook member and base member together so that forces acting on the hook member, either from manually rotating it or winding the cord on to it, are spread out over the engaging surfaces and not applied to the threaded connector. The base member preferably has a continuous internally walled extension defining a central opening therein. The hook member also preferably has a continuous externally walled extension insertable in the opening defined by the internally walled extension of the base member. The engaging surfaces of the hook member and base member are so constructed and arranged as to allow the hook member to be rotated within the base member so that the cord can be more easily taken off of the hook member all at once by simply rotating the hook member 180 degrees from its normally upright position while maintaining supporting engagement between the hook member and base member. Also, the inner wall of the base member and the engaging outer wall of the hook member are preferably tapered so that if the hook member is pulled out slightly against the biasing force of the spring the engaging surfaces will disengage and the hook member can be more easily rotated within the base member. In addition, mating shelves on the hook member and base member establish a predetermined distance that the hook member can be inserted into the base member such that the engaging surfaces can engage but not become so wedged together that the hook member can not easily be pulled out or rotated.

In addition to the single hook arrangement, the present invention includes a second embodiment which includes two hook members so that the vacuum hose can be laid over the first hook member adjacent the base member and the electrical cord can be wound about the second hook member is and a third hook member on the handle of the vacuum. The first hook member is received in the base member as in the first embodiment and then a second hook member is received in the first hook member. A threaded member extends through the first and second hook members and is engageable with the base member and a spring is concentrically mounted with the threaded member and engages the second hook member so as to bias the second hook member against the first hook member and the first hook member against the base member. Like the first embodiment the base member has a continuous internally walled extension defining an opening therein and the first hook member has a continuous externally walled extension insertable in the opening of the walled extension of the base member such that the external wall of the first hook member engages at least a portion of the internal wall of the base member so that forces applied externally to the first hook member are transferred through the engaging surfaces to the base member, the first hook member also having a continuous internally walled portion defining an opening therein. The second hook member has a continuous externally walled extension insertable in the opening of the internally walled portion of the first hook member such that the external wall of the second hook member engages at least a portion of the internal wall of the first hook member so that forces applied externally to the second hook member are transferred through the engaging surfaces to the first hook member. Also, the walled extensions of the base member and first hook member are adapted to permit rotation of the first hook member within the base member and the walled extension of the second hook member and the internally walled portion of the first hook member are adapted to permit rotation of the second hook member within the first hook member.

BRIEF DESCRIPTION OF THE DRAWINGS

A preferred embodiment of the present invention is shown in the drawings, wherein.

DETAILED DESCRIPTION OF THE PREFERRED EMBODIMENTS

Figure 1:
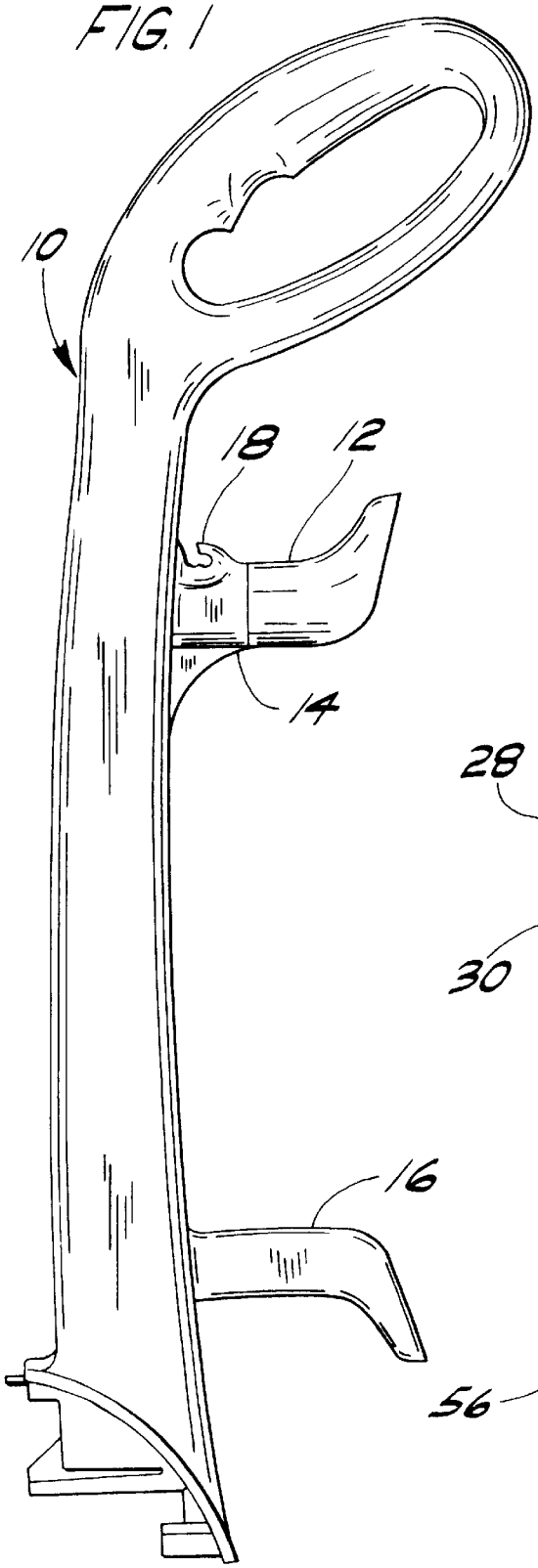
FIG. 1 is a side view of the handle portion of a vacuum cleaner in accordance with a first embodiment of the present invention.
Figure 2:
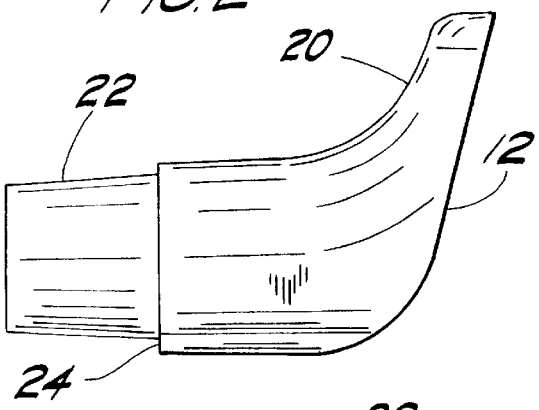
FIG. 2 is a side view of the hook member of the embodiment of FIG. 1.
Figure 3:
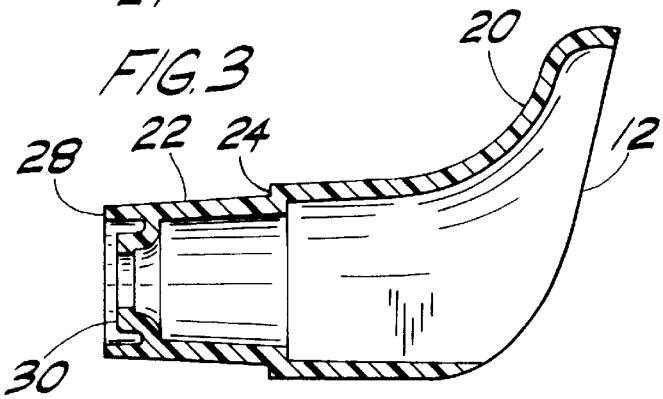
FIG. 3 is a cross-sectional view through the hook member of FIG. 2.
Figure 4:
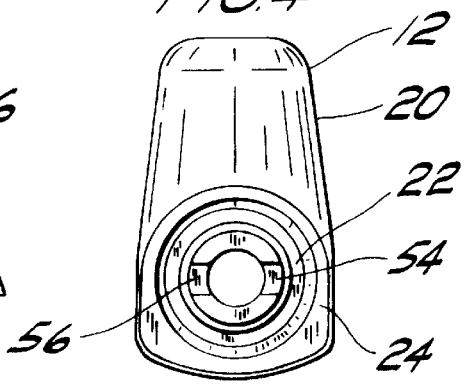
FIG. 4 is a front view of the hook member of FIG. 2 looking from left to right in FIG. 2.
Figure 5:
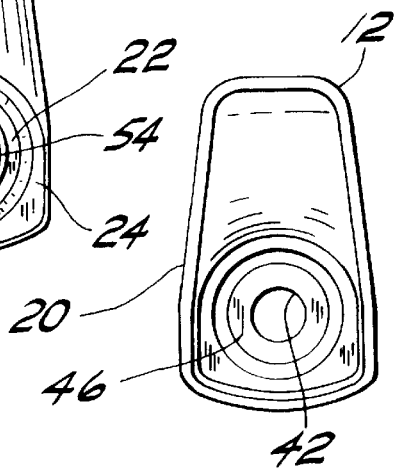
FIG. 5 is a rear view of the hook member of FIG. 2 looking Mom right to left on FIG. 2.

As illustrated in FIG. 1, a vacuum cleaner handle 10 is provided with an electrical cord storage arrangement in accordance with a first embodiment of the present invention where a hook member 12 is mounted to the upper portion of handle 10. Hook member 12 is received in a base member 14 formed integral with handle 10, all of which is preferably made of plastic although it could be formed from other materials or made as an assembly. A further hook member 16 is formed near the lower end of handle 10 so that the vacuum cleaner's electrical cord can be wound around the two hook members in a well known manner. Formed in the base member 14 is a smaller hook 18 which can receive a single wrap of electrical cord slightly wedged therein to hold it in place to prevent the cord from unwrapping from hook members 12 and 16.

Figure 6:
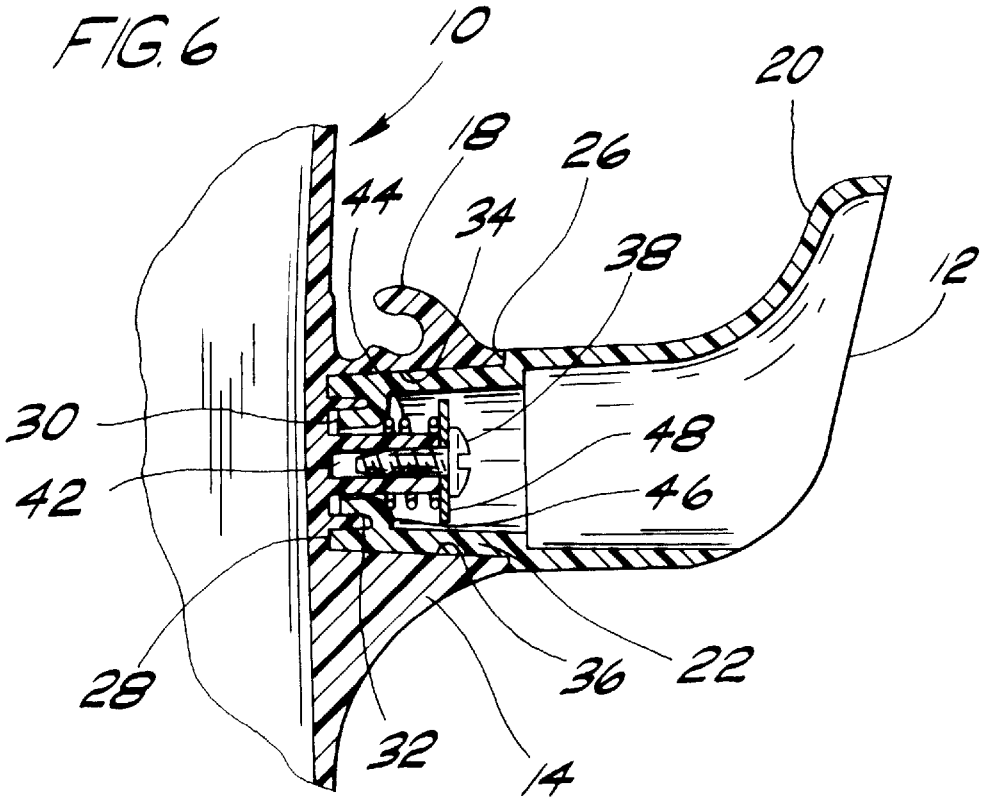
FIG. 6 is an enlarged partial cross-sectional view of the assembly of the handle of FIG. 1 in the area of the hook member.
Figure 7:
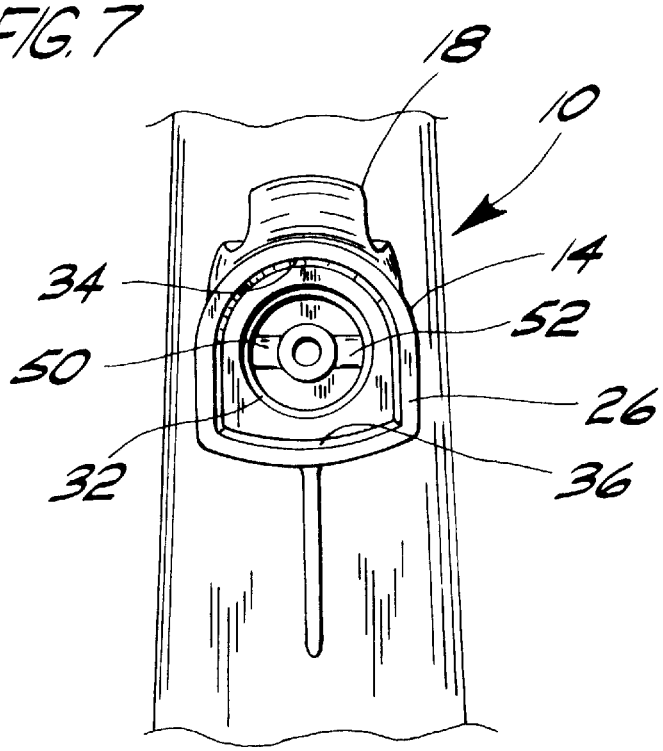
FIG. 7 is an enlarged view of a portion of the handle of FIG. 1 with out the hook member in place.

Hook member 12, as best seen in FIGS. 2–5, is a generally hollow plastic member with an upwardly extending hook portion 20 which merges into a continuous externally walled extension 22, essentially in the form of a truncated cone. A shelf 24 is formed at the merger of the hook 20 and extension 22 which engages the outer extremity 26 of the base member 14 to establish the maximum insertion of the extension 22 into the base member 14. The external shape of the hook portion 20 is designed to match the external shape of base member 14 and can be of any desired configuration. The outer end 28 of extension 22 is annular and a concentric recessed annular portion 30 formed in side of extension 22 matingly receives therein an annular lip 32 formed in the interior space of base member 14, as shown in FIG. 6. This interengaging of the annular lip 32 between the internal wall of the extension 22 and the outer wall of annular portion 30 assists in transferring any loads applied to the hook member 12 to the handle through the base member. However, the main load transfer from the hook member 12 to the base member 14 is through the continuous external wall 22 of the hook member 12 and corresponding engaging surface portions 34 and 36 on the base member 14, as seen in FIGS. 6 and 7. The upper surface portion 34 is tapered at the same angle as extension 22 and is semi-conical so that it engages the outer surface of extension 22 over approximately 180 degrees. The bottom surface 34 on the other hand although tapered at the same angle as extension 22 it is arced and only engages the outer surface of extension in essentially line contact. It is to be understood that other forms of contact would be equally acceptable such as continuous contact between the outer surface of extension 22 and inner surface of base member 14 if they are surfaces of revolution and preferably tapered for easy removal of the hook member 12 from the base member 14.

A threaded member 38 in the form of a screw passes through the opening 40 on the inside of the hook member 12 with clearance and is threadably engaged in a hole 42 in the base member. A spring 44 is concentrically mounted with the threaded member and is compressed between the inner surface 46 and washer 48 to bias the shelf 24 of hook member 12 against the outer end 26 of the base member 14 so as to normally keep the external surface portions of extension 22 in engagement with the corresponding inner surfaces of base member 14 to distribute any applied load to the hook member 12 through the engaged surfaces and not through the threaded member 38 as in prior art devices. The biasing force applied by spring 44 can be manually overcome by pulling out on the hook member 12 so as to more easily rotate the hook member 12 within the base member by disengaging the otherwise engaged surfaces.

Figure 8:
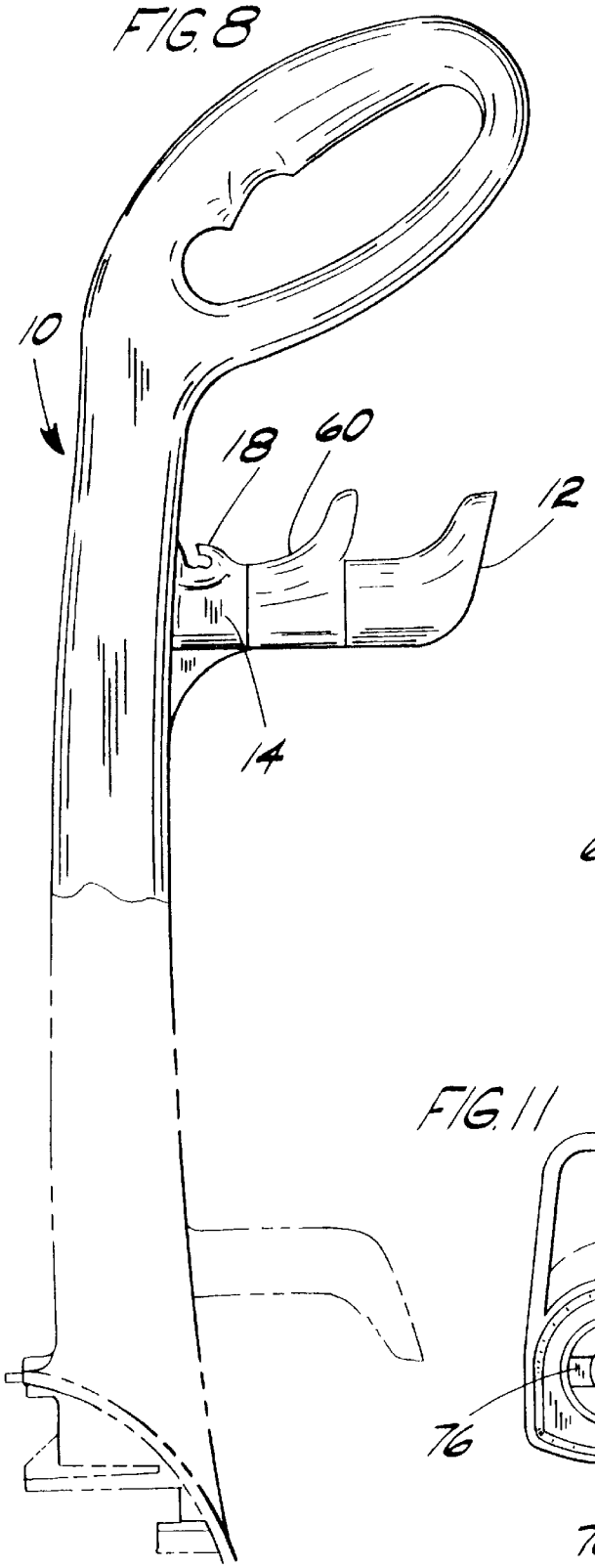
FIG. 8 is a side view illustrating a second embodiment of the present invention with two hook members.

As shown in the bottom of the base member 14 in FIG. 8, there are raised cross members 50 and 52 on opposites sides of hole 42. In the outer end of extension 22 on hook member 12 there are corresponding slots 54 and 56 (see FIG. 4) in the annular portion 30 which normally receive the cross members 50 and 52 under the bias of spring 44 to position the hook member 12 in a normally upright position. When the hook member 12 is manually pulled out it disengages the slots 54 and 56 from the cross members 50 and 52 to allow the hook to be rotated 180 degrees where, upon manual release of the hook member it will be biased in a downwardly directed position with slots 54 and 56 engaged with the opposite cross members 50 and 52. In this position the cord can easily be removed from the hook members 14 and 16 by sliding the wound cord off of the hook member 12.

Referring now to a second embodiment of the present invention as shown in FIGS. 8–13, it is similar to the first 170 embodiment except it has an additional hook member to allow the vacuum hose as well as the electrical cord to be positioned on the top hook members. The vacuum hose which is commonly used with attachments to clean drapes or furniture or the like is not wound around two hook members like the cord, but is draped over the top hook member to keep it off the ground and out of the way when the vacuum is be used as a floor vacuum by pushing the handle 10. Where parts of the two embodiments are identical like numbers are used throughout the drawings.

Figure 9:
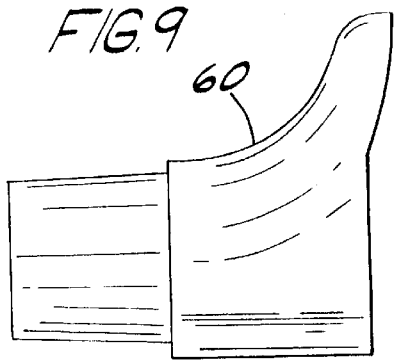
FIG. 9 is a side view of the second hook member of the embodiment of FIG. 8.
Figure 10:
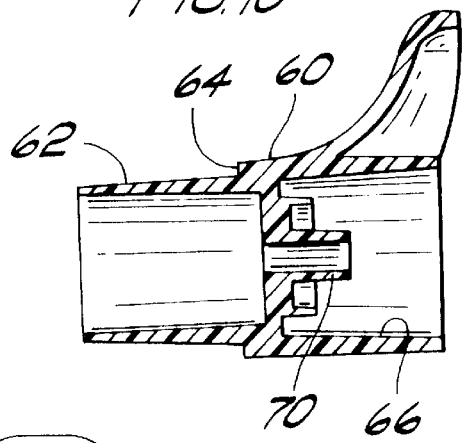
FIG. 10 is a cross-sectional view through the second hook member of FIG. 9.
Figure 11:
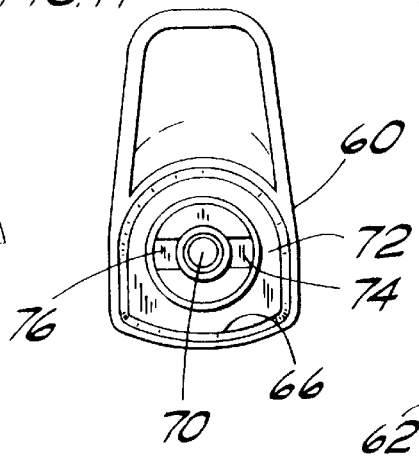
FIG. 11 is a front view of the second hook member of FIG. 9 looking from left to right, in FIG. 9.
Figure 12:
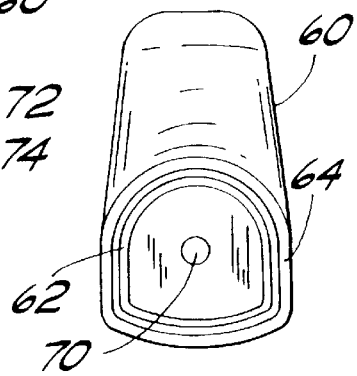
FIG. 12 is a rear view of the second hook member of FIG. 9 looking from[]right to left on FIG. 9.
Figure 13:
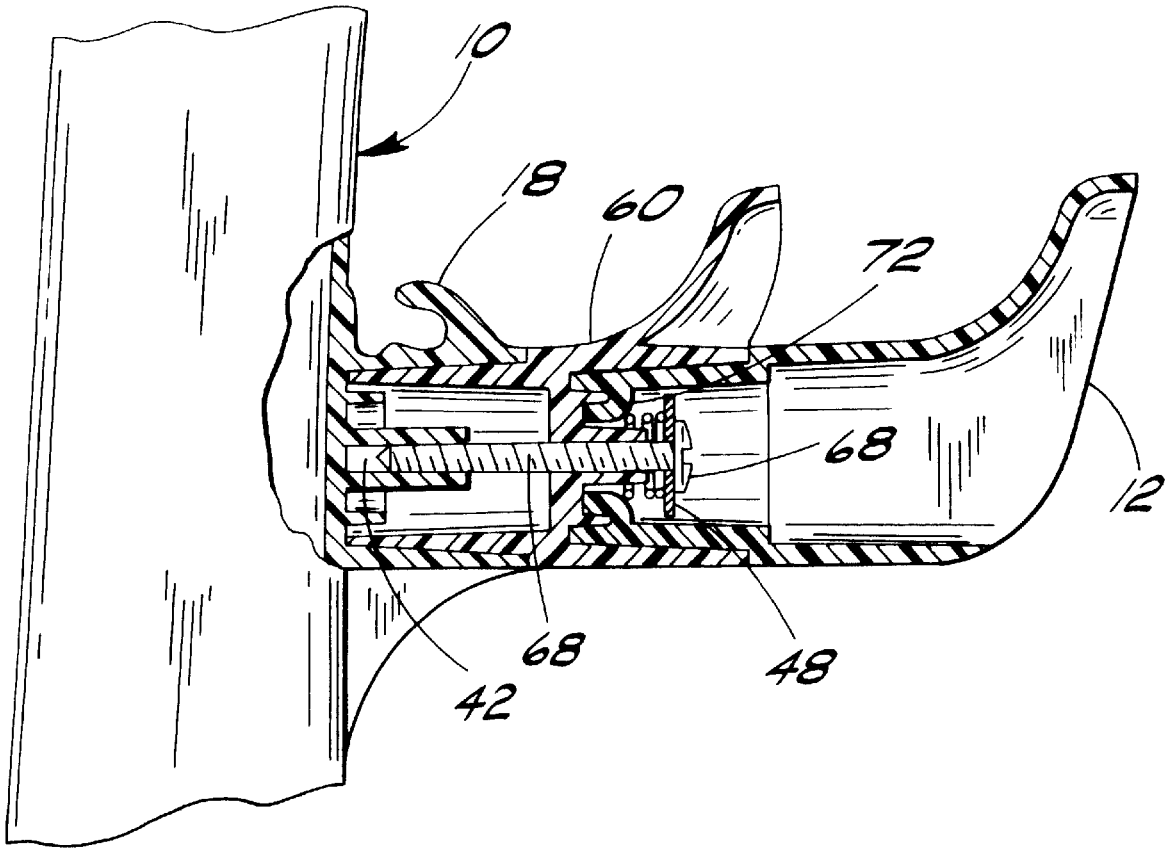
FIG. 13 is an enlarged partial cross-sectional view of the assembly of the handle of FIG. 8 in the area of the hook members.

Hook member 12 is used as the outer most or second hook member in this embodiment as seen in FIG. 9 and is identical to that in the first embodiment which is advantageous from a parts inventory point of view. Likewise, the handle 10 and integral base member 14 are identical. Hook member 60 is different from hook member 12 in several respects. Hook member 60 has an externally walled extension 62 of matching shape to the internal opening of base member 14 with an identical taper so that it mates with the interior wall of base member 14. Thus, it cannot be rotated and remains in an upright position to support the vacuum hose. The shelf 64 engages the outer end 26 of base member 14 to limit the insertion depth of hook member 60 into the base member 14, but is so positioned and arranged that the exterior surface of extension 62 engages the interior surface of base member 14 to transmit loads from the hook member 60 to base member Hook member 60 has a continuous internally walled portion 66 identical to the internally walled configuration of base member 14 so as to receive extension 22 of hook member 12 in the same way that the base member 14 does in order to transmit loads in the same manner. A longer threaded member 68 is used which extends through a hole 70 formed in hook member 60 and is threaded into hole 42 in base member 14. Spring 44 is compressed between a shelf 72 formed in hook member 60 and washer 48. Thus, portions of extension 22 of hook member 12 are normally biased into engagement with portions of the interior surface of hook member 60 to transmit loads applied to hook member 60 through those surfaces instead of through the threaded member or screw 68.

As in the bottom of the base member 14, there are formed in the bottom of the opening formed by the interior walled surface 66 raised cross members 74 and 76 on opposites sides of hole 70. As mentioned above, the outer end of extension 22 on hook member 12 has corresponding slots 54 and 56 (see FIG. 4) formed in the annular portion 30 which normally receive the cross members 74 aid 76 under the bias of spring 44 to position the hook member 12 in a normally upright position. When the hook member 12 is manually pulled out it disengages the slots 54 and 56 from the cross members 74 and 76 to allow the hook to be rotated 180 degrees where, upon manual release of the hook member it will be biased in a downwardly directed position with slots 54 and 56 engaged with the opposite cross members 50 and 52. In this position the cord can easily be removed from the hook memrbers 12 and 16 by sliding the wound cord off of the hook member 12, as in the first embodiment.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. The combination of a hook assembly and a vacuum cleaner handle, comprising:

a base member integrally formed with the vacuum cleaner handle and having a continuous internally walled extension defining a central opening therein;

a hook member defining a hook portion on the outer surface thereof and having a continuous externally walled extension insertable in the opening of the walled extension of the base member such that the external wall thereof engages at least a portion of the internal wall of the base member so that forces applied externally to the hook member are transferred through the engaging walls to the base member;

a threaded connector extending through the hook member and engaging the base member;

a spring concentrically mounted to the threaded connector and engaging the hook member to bias the external wall of the hook member into engagement with the at least a portion of the internal wall of the base member; and a planar surface within the central opening of the base member and a planar surface on a distal end of the external wall of the hook member disposable adjacent the planar surface on the base member when the hook member is inserted in the base member and at least one transverse ridge defined on a portion of the planar surface of the base member and a corresponding notch in the planar surface of the hook member for receiving the ridge when the spring biases the two planar surfaces together to normally prevent rotation of the hook member in the base member and permit rotation by movement of the hook member outwardly from the base member a sufficient distance that the ridge is removed from the notch.

2. The hook assembly as claimed in claim 1, wherein the at least a portion of the internal wall of the base member is tapered outwardly and the external wall of the hook member is matingly tapered so that when the hook member is inserted into the base member, the inner wall of the base member and the outer wall of the hook member engage.

* * * * *